US010102710B2

(12) United States Patent
Boese et al.

(10) Patent No.: US 10,102,710 B2
(45) Date of Patent: Oct. 16, 2018

(54) GAMES AND GAMING MACHINES HAVING PRIZES TRIGGERED BY EXPANDING REELS

(71) Applicant: Cadillac Jack, Inc., Duluth, GA (US)

(72) Inventors: Eric Steven Boese, Decatur, GA (US); Timothy Curtis Ryan, Duluth, GA (US)

(73) Assignee: AGS LLC, Las Vegas, NV (US)

( * ) Notice: Subject to any disclaimer, the term of this patent is extended or adjusted under 35 U.S.C. 154(b) by 69 days.

(21) Appl. No.: 15/254,178

(22) Filed: Sep. 1, 2016

(65) Prior Publication Data

US 2018/0061174 A1 Mar. 1, 2018

(51) Int. Cl.
*G07F 17/32* (2006.01)

(52) U.S. Cl.
CPC ..... *G07F 17/3213* (2013.01); *G07F 17/3209* (2013.01); *G07F 17/3244* (2013.01); *G07F 17/3267* (2013.01)

(58) Field of Classification Search
CPC ..... G07F 17/3213; G07F 17/3244; G07F 17/3265; G07F 17/3267; G07F 17/34
See application file for complete search history.

(56) References Cited

U.S. PATENT DOCUMENTS

| | | | |
|---|---|---|---|
| 5,890,962 | A | 4/1999 | Takemoto |
| 6,544,120 | B2 | 4/2003 | Ainsworth |
| 7,601,062 | B2 | 10/2009 | Cole et al. |
| 7,654,895 | B2 | 2/2010 | Pacey |
| 8,246,442 | B1 | 8/2012 | Barrie |
| 8,512,124 | B2 | 8/2013 | Bramble et al. |
| 8,602,868 | B2 | 12/2013 | Johnson et al. |
| 8,795,059 | B2 | 8/2014 | Aoki et al. |
| 2005/0159208 | A1 | 7/2005 | Pacey |

(Continued)

FOREIGN PATENT DOCUMENTS

| | | |
|---|---|---|
| AU | 2007202050 | 8/2007 |
| AU | 2007201998 | 11/2007 |

(Continued)

OTHER PUBLICATIONS

Aristocrat, video of Aristocrat "Buffalo Stampede" game, https://www.youtube.com/watch?v=C-P0WkDbr8Y, Jul. 12, 2013, 1 page.

(Continued)

*Primary Examiner* — Jasson Yoo
(74) *Attorney, Agent, or Firm* — Weide & Miller, Ltd.

(57) ABSTRACT

In a game event a first set of game symbols are displayed in a game symbol display area, at least one prize is displayed in a prize display area, and an expanded second set of game symbols having at least one game symbol located in the prize display area is displayed. A winning game outcome may be declared if at least one game symbol located in the prize display area contacts at least one prize which is displayed in the prize display area. The game event may be presented via a uniquely configured gaming machine or system in which the game symbols and prizes are generated and displayed as graphical elements on a video display. The game event may be presented as or as part of a wagering event.

20 Claims, 9 Drawing Sheets

(56) References Cited

U.S. PATENT DOCUMENTS

| | | | | |
|---|---|---|---|---|
| 2006/0063588 | A1* | 3/2006 | Poole | G07F 17/3244 463/25 |
| 2006/0247002 | A1 | 11/2006 | Yoshimi et al. | |
| 2007/0060255 | A1 | 3/2007 | Bearlocher et al. | |
| 2007/0281784 | A1* | 12/2007 | Seelig | G07F 17/32 463/26 |
| 2008/0108408 | A1 | 5/2008 | Wolf | |
| 2009/0156287 | A1 | 6/2009 | Baumgartner | |
| 2010/0113133 | A1 | 5/2010 | Leupp | |
| 2010/0203948 | A1 | 8/2010 | Falciglia, Sr. | |
| 2011/0244943 | A1 | 10/2011 | Milford et al. | |
| 2012/0015707 | A1 | 1/2012 | Hornik et al. | |
| 2012/0077564 | A1 | 3/2012 | Collette et al. | |
| 2012/0094738 | A1 | 4/2012 | Aoki et al. | |
| 2013/0102375 | A1* | 4/2013 | Aoki | G07F 17/32 463/20 |
| 2013/0260861 | A1 | 10/2013 | Vann et al. | |
| 2015/0206386 | A1 | 7/2015 | Jaffe et al. | |
| 2015/0379831 | A1 | 12/2015 | Lee | |
| 2016/0042597 | A1 | 2/2016 | Olive | |
| 2016/0155303 | A1 | 6/2016 | Aoki et al. | |

FOREIGN PATENT DOCUMENTS

| | | | | |
|---|---|---|---|---|
| AU | 2007202816 | 2/2008 | | |
| AU | 2008203119 | 3/2009 | | |
| AU | 2008246265 | 6/2009 | | |
| AU | 2009201685 | 11/2009 | | |
| AU | 2009202582 | 1/2010 | | |
| AU | 2009230736 | 5/2010 | | |
| AU | 2011200159 | 2/2011 | | |
| AU | 2011265432 | 1/2012 | | |
| AU | 2011265544 | 2/2012 | | |
| AU | 2013200813 | 2/2012 | | |
| GB | 2353128 A | * 2/2001 | | G07F 17/34 |

OTHER PUBLICATIONS

Random $$ Slots, video of Multi Media Games "Thundering Herd" game, https://www.youtube.com/watch?v=_s1EPR93y9U, Sep. 5, 2015, 1 page.

* cited by examiner

GAMES AND GAMING MACHINES HAVING PRIZES TRIGGERED BY EXPANDING REELS

FIELD OF THE INVENTION

The present invention relates to methods of presenting and playing games and gaming machines configured to present games.

BACKGROUND OF THE INVENTION

Many styles of gaming machines and games are known, including casual (or non-wagering) gaming and wager-based gaming. One popular style of game is the wager-based slot game. Slot games were originally presented by slot machines which utilized physical spinning reels to display a set of game symbols which defined the outcome of the game. Later, however, video slot machines were developed which display graphical representations of reels and associated slot symbols.

In order to make video slot games more exciting, various features have been added to those games. One popular and well known feature is the "expanding reel." Normally a slot game is configured to display a fixed number of game symbols to a player, such as 15 symbols in the case of a 3×5 matrix of game symbol positions (5 reels each displaying a column of 3 symbols). In the case of the expanding reel feature, one or more additional symbol positions and game symbols may be displayed, such as disclosed in U.S. Pat. No. 6,544,120 (a trigger results in the display of additional symbols, thus extending existing pay lines or allowing additional pay lines), U.S. Pat. No. 8,602,059 (where the size of the symbol array may increase as a part of a mystery feature, thus allowing more pay lines) and U.S. Pat. No. 8,795,059 (where an increase in the size of a base array is indicated by the symbols displayed in that array), and U.S. Patent Application Publication No. 2016/0042597 (which describes a game area expander for expanding said game area in response to at least one predefined triggering criterion being satisfied, such that at least one additional symbol of the set of symbols is displayed in an expanded game area).

The expanding reel feature adds excitement because the addition of one or more game symbols to the set of displayed symbols may be used to form additional or different winning combinations of game symbols. While the expanding reel feature has been popular, it is well known and thus other innovative game features are desired in order to maintain the excitement of the game(s) and the interest of the players.

SUMMARY OF THE INVENTION

Embodiments of the invention comprise game events, method of playing and presenting games or game events, and gaming machines and gaming systems.

One embodiment of the invention is a game event which includes the display or presentation of a first set of game symbols in a game symbol display area, at least one prize in a prize display area, and an expanded second set of game symbols having at least one game symbol located in the prize display area. A winning outcome may be declared if at least one game symbol located in the prize display area contacts at least one prize which is displayed in the prize display area. In the event of a winning outcome, the prize or award may be awarded to the player.

In one embodiment, the prize display area is located above the base game symbol area.

In one embodiment, the second set of game symbols comprises the first set of game symbols expanded by the addition of one or more game symbols. The sets of game symbols may be displayed in rows or columns, such as where the columns represent game reels, and where the expansion of symbols increases the height of one or more of the columns or reels.

The game event may be presented as a primary wagering game or may be part of or associated with another wagering game, such as by comprising a bonus or secondary event to a primary wagering game.

The game event may be presented via a uniquely configured gaming machine or system in which the game symbols and prizes are generated and displayed as graphical elements on a video display.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise games or game events, methods of playing and presenting games, gaming machines and gaming systems. In a preferred embodiment, the methods of game play and presentation are implemented via a gaming machine or gaming system.

One embodiment of the invention comprises a unique configured gaming machine. Such a gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
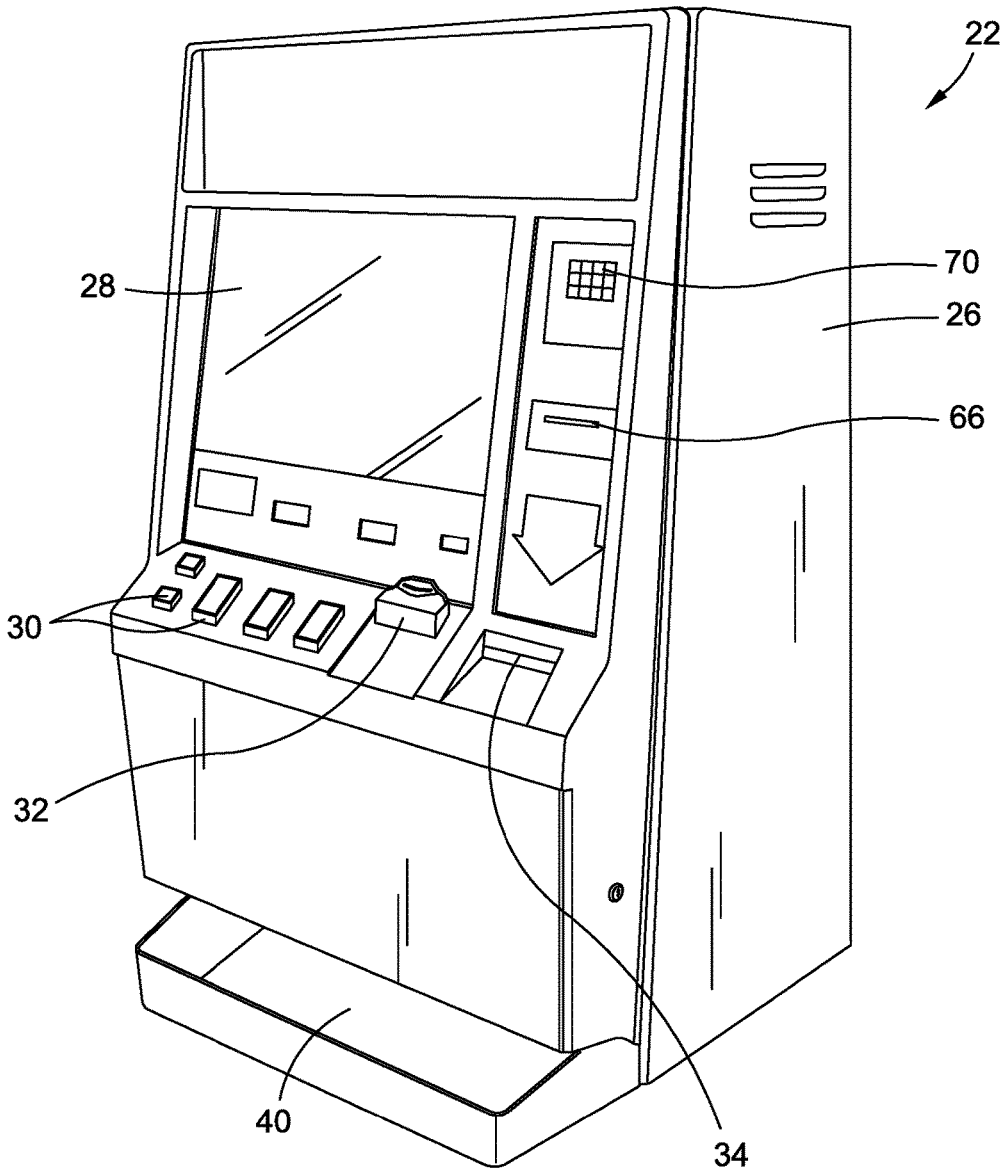
FIG. 1 illustrates one embodiment of a gaming machine in accordance with the present invention.

One configuration of a gaming machine 22 is illustrated in FIG. 1. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26. The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes.

While the display devices may comprise one or more video displays, in another embodiment, the gaming machine 22 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference. Such reels may include a video display or other features, such as a video display which allows images to be displayed over the physical reels or the symbols displayed thereby.

As described in more detail below, the gaming machine 22 is preferably configured to present one or more games upon a player making a monetary payment or wager. In this regard, as described in more detail below, the gaming machine 22 includes mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to "cash out" of the gaming machine, or to provide various other inputs.

In one preferred embodiment, the gaming machine 22 includes at least one microprocessor or controller for controlling the gaming machine, including receiving player input and sending output signals for controlling the various components or peripheral devices of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 (such as information comprising prizes, prize positions, game symbols and the like, as detailed below), for determining winning or losing game outcomes and for displaying information regarding awards for winning game outcomes, among other things.

The controller may be configured to execute machine readable code or "software" or otherwise process information, such as obtained from a remote server. Software or other instructions may be stored at a memory or data storage device, e.g. in a fixed or non-transitory configuration. The memory may also store other information, such as pay table information. The gaming machine 22 may also include one or more random number generators for generating random numbers, such as for use in selecting slot symbols and prizes (as described below) and for presenting the game in a random fashion (e.g. whereby the game is presented in a manner in which the player cannot control the outcome) or pseudo-random fashion (e.g. such as where the game includes a skill component which can affect the outcome of the game).

Preferably, the controller is configured to execute machine readable code or instructions which are configured to implement the game. In this regard, the gaming machine is specially configured to present the game of the invention via specific software and/or hardware which causes the gaming machine to operate uniquely. For example, the controller of the gaming machine 22 may be configured to detect a wager, such as a signal from a player's depressing of the "bet one" button. Upon such an event and/or the player otherwise signaling the gaming machine to present the game, the controller may be configured to cause the at least one display 28 to display unique information, such as a unique graphical interface or unique game display, including game symbols or other game information. The controller may accept input from a player of game inputs, such as a request to spin reels or the like, via the one or more player input devices of the gaming machine 22. It will be appreciated that the machine readable code may be configured in various manners, such as by having various "modules" of software which are designed to implement specific features of the game play or game presentation.

The gaming machine 22 may be configured to generate and present games in a stand-alone manner or it may be in communication with one or more external devices or systems. The gaming machine 22 might communicate with one or more of such external devices or systems via one or more communication ports or other interface devices. These ports or interface devices may be configured to implement various communication protocols (including proprietary protocols) and communicate via wireless, wired or other communication links. For example, the gaming machine 22 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 22 is configured to present one or more wagering games. The gaming machines 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications, such as to enable the transfer of funds from the player to the gaming machine or system.

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In this regard, the gaming machine 22 may include one or more media printers or writers 48. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player tracking device, such as a card reader 66 and/or associated keypad 70 or other input device (such as a touch screen display). Such player tracking devices are well known and may permit the game operator to track play of players of the gaming machine. The tracked play may be utilized to offer player bonuses or awards.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIG. 1 is only exemplary of one embodiment of a gaming machine. For example, it is possible to for the gaming machine to have various other configurations, including different shapes and styles and having different components than as just described.

For example, instead of comprising a "casino"-style gaming machine, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays.

The gaming machine 22 may, as noted above, be part of a system which includes other devices. For example, the gaming machine 22 may communicate with one or more casino systems, such as a player tracking server or system, an accounting system or server, a ticketing system, a bonusing system, a tournament system, other gaming machines, and external devices.

Figure 2:
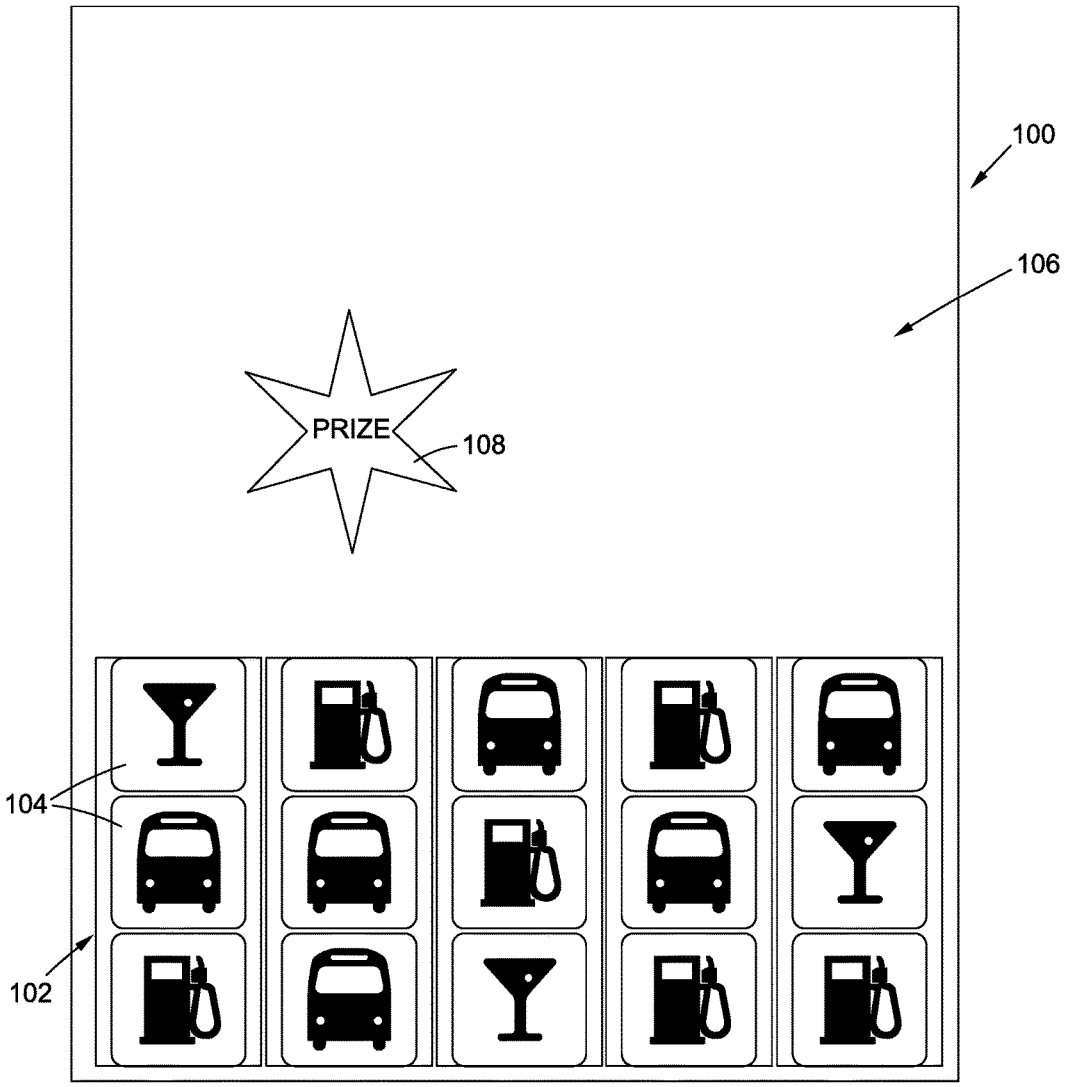
FIG. 2 illustrates a display or portion thereof displaying game information in accordance with one embodiment.

One embodiment of the invention is a game event. The game event may be presented relative to a game or spin event as described below. The game event may be presented by a gaming machine or system. As illustrated in FIG. 2, in one embodiment the game event comprises displaying game information 100 to a player. The game information 100 preferably comprises game symbols and one or more prizes or awards. In one embodiment, one or more game symbols 104 are displayed in a base game symbol area 102 and one or more prizes or awards 108 may be displayed in a prize display area 106. In one embodiment, the prize display area 106 is above the base game symbol area 102, but it could be arranged in other locations.

In one embodiment, game symbols are displayed in the base game symbol area 102, such as in base game symbol locations in the base game symbol area. In one embodiment, the base game symbol locations may be arranged into a number of rows and columns. For example, in the illustrated embodiment, the base game symbol locations may comprise a matrix of 3 rows and 5 columns (e.g. a 3×5 matrix). The columns of game symbols may be associated with real or virtual game reels (e.g. a strip of adjacent symbol positions), or each symbol location may be independent, such as being associated with its own reel.

While the base game symbol locations may comprise a matrix of m×n locations, the base game symbol locations might comprise other locations arranged in other manners, including where the number of locations per row and/or per column may vary from row to row and/or column to column as well as irregular arrangements of symbol locations.

In one embodiment, game symbols are displayed in or at one or more, and preferably all, of the game symbol locations. The game symbols which are displayed may be selected, for example, using one or more random number generators or the like. The game symbols might be selected individually or in sets (such as by "spinning" a virtual or actual reel), based upon weighted selection or various other criteria. In one embodiment, the game symbols may be selected individually from a set of game symbols or might be selected in sets, such as from sets of game symbols or the like.

Likewise, at one or more times, one or more prizes or awards 106 may be displayed in the prize display area 106, such as in expanded game symbol positions which are outside of the base game symbol area 102 and within the prize display area 106. As disclosed below, the prizes or awards 106 may be selected or determined in various manners, as may the number of prizes, their size and/or their displayed location.

Figure 3:
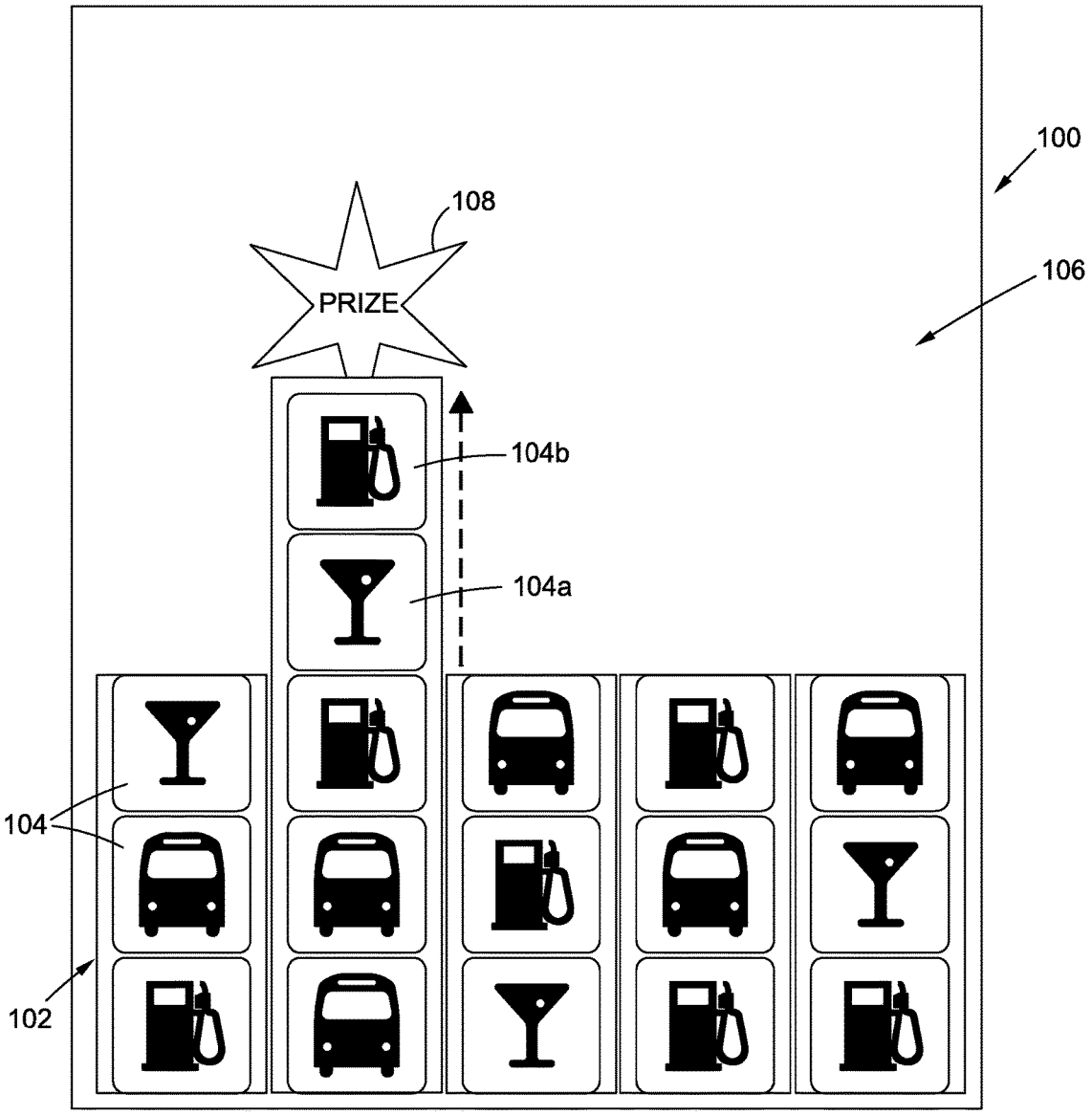
FIG. 3 illustrates a display or portion thereof displaying game information in accordance with one embodiment.

Referring to FIG. 3, at one or more times, the number of displayed game symbols 104 may be increased or expanded such that one or more game symbols 104*a,b* are displayed outside of the base game symbol area 102 and in the prize display area 106. In one embodiment, if one or more game symbols are displayed in the prize display area 106 at the location of a displayed prize 108 (e.g. the symbol contacts a displayed prize such as by touching or partially or fully overlapping the displayed prize), then the prize is preferably awarded or won. In one embodiment, the contact or overlap of a single symbol with a prize may be sufficient to win the prize, but in other embodiments, two or more symbols may need to contact or overlap a prize. In one embodiment, any contact or overlap of a symbol with a prize may be sufficient, while in other embodiments, it is possible to require that a symbol either completely cover a prize, require that a symbol fall within a prize, or other overlapping/contacting criteria may be applied.

In the embodiment illustrated in FIGS. 2 and 3, the base game symbol area 102 (and thus the base game symbol locations and the associate displayed base game symbols) have a first height and the prize display area 106 is located above that height. In this configuration, the number of displayed game symbols may be increased or expanded so that one or more game symbols may be displayed above that first height and thus inside the prize display area 106, as illustrated in FIG. 3.

In one embodiment, the addition of a single game symbol in the vertical direction might cause at least one game symbol to be displayed in the prize display area 106. In other embodiments, the prize display area 106 might start at a second height above the first height, whereby an increase or expansion by multiple game symbols may be required before one or more of the game symbols is displayed in the prize display area 106.

The number of displayed game symbols 104 may be increased or expanded in various manners. For example, the number of displayed game symbols 104 might increase between first and second spins or displays of game symbols. As one example, a first set of game symbols might be displayed in the base game symbol display area in a first game and then an expanded second, greater number of game symbols might be displayed in a second game, wherein one or more the game symbols in the second set may be displayed in the prize display area. As another example, a player might be presented with multiple spin opportunities in a bonus feature of a game, where a first set of game symbols might be displayed in a first spin and an expanded second set of game symbols might be displayed in a second spin. The expanded second set of game symbols might comprise an entirely different set of game symbols from the first set, or might comprise the first set of game symbols along with one or more additional game symbols.

In another embodiment, the number of displayed symbols might be increased during the same game or spin. For example, the result of a first game or spin might be the display of a first set of game symbols. However, as a result of a certain outcome, a random trigger or the like, an expanded second set of game symbols may be displayed. The expanded second set of game symbols might comprise an entirely different set of game symbols from the first set, or might comprise the first set of game symbols along with one or more additional game symbols.

In one embodiment, the number of displayed game symbols may increase from a base number of game symbols to one or more increased number of game symbols. In one embodiment, the number of game symbols in one or more columns may be increased. For example, FIG. 3 illustrates an embodiment where the number of game symbols in the second column has been increased by two (2) from three (3) to five (5). Of course, the number of symbols in a column might be increased by other numbers of symbols. Further the number of symbols might be increased in other manners, such as by an entire row or rows.

The number of displayed game symbols might also increase or grow in steps. For example, in a first game or spin, the base number or first set of game symbols might be displayed. In a second game or spin, the number of displayed game symbols in 1 or more columns might expand or grow by 1 or more, and in a third game or spin, the number of displayed game symbols in one or more columns might further grow by 1 or more.

It will also be appreciated that instead of the number of displayed game symbols increasing or expanding, the size of one or more game symbol locations might expand or grow. For example, the size of one or more base game symbols might expand or increase so that it or other of the game symbol locations then extend into the prize or award display area 106.

In the embodiment illustrated in FIGS. 2 and 3, the prize display area 106 is located above the base game symbol display area 102. However, a prize display area might additionally, or instead, be located below or to either side of the base game symbol display area 102. In such configurations, the displayed game symbols might be configured to increase or expand downwardly or to either side.

As indicated above, one or more prizes or awards 108 may be displayed in the prize display area 106. A prize or award need not be displayed all of the time. However, randomly, based upon player wager, coin/monetary value in, monetary value lost, monetary value won, based upon one or more triggering events, or based upon any variety of criteria, one or more prizes or awards 108 may be displayed. The display of the one or more prizes or awards 108 may be determined on a game to game or spin to spin basis, may extend the duration of multiple games or spins, during an entire bonus round, etc.

The prizes or award may be displayed in various manners. In one embodiment, a prize or award is displayed as a symbol or icon, such as a graphically displayed symbol. As noted herein, the size, shape and location of a displayed prize or prize symbol may vary.

The prizes or awards 108 may vary. For example, by way of example but not limitation, such might comprise free games, free spins, the triggering of certain game features, credits or other monetary value, jackpots, progressive jackpots, non-monetary prizes and other awards. In the case of a monetary value award, such as a number of credits, the credits may be added to the player's credit balance at the machine for later cash-out. Other awards, such as free spins and the like, may simply be implemented at the gaming machine. Other prizes might be awarded via a redemption ticket or the like which is issued to the player at the gaming machine.

Figure 4:
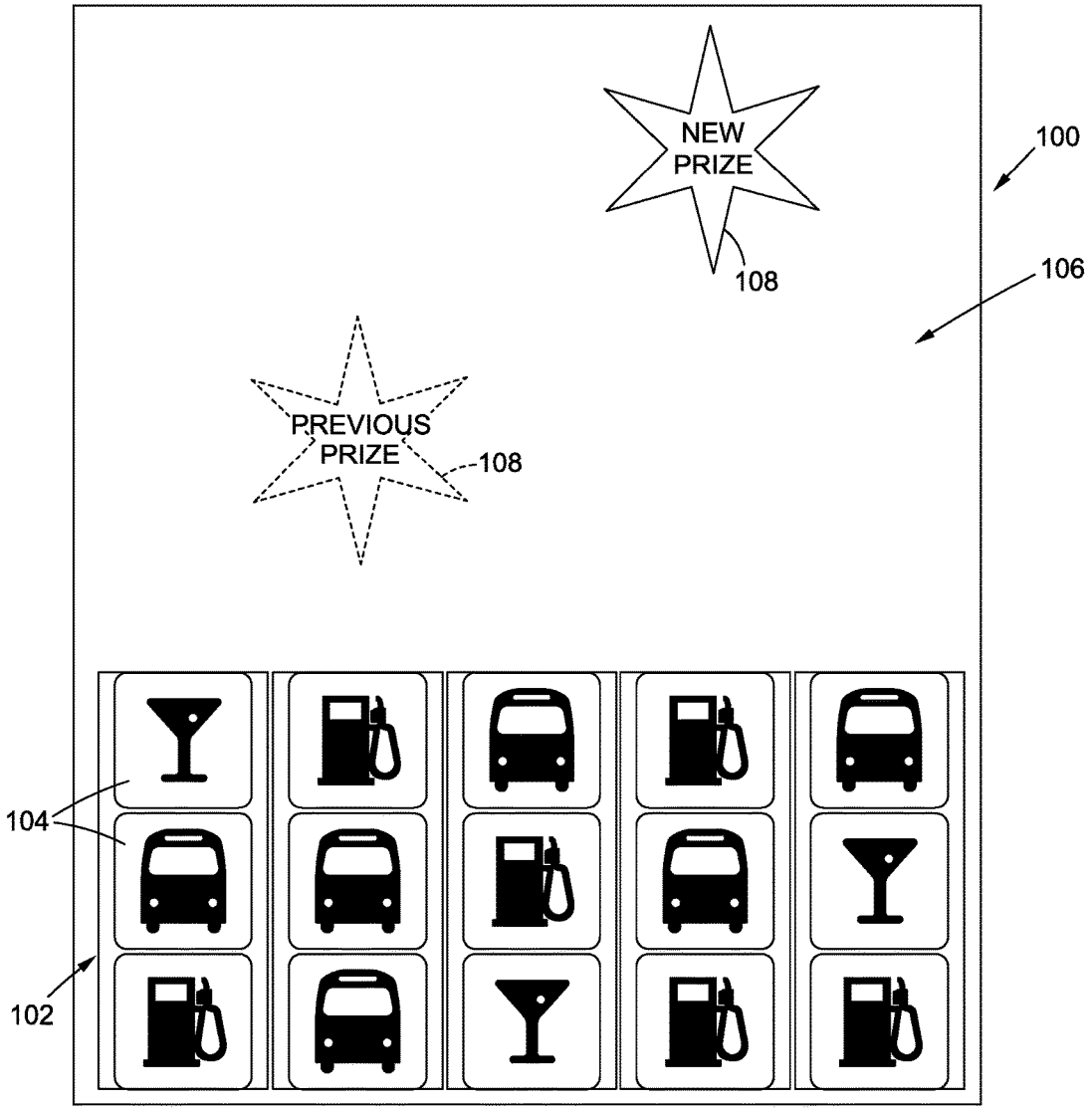
FIG. 4 illustrates a display or portion thereof displaying game information in accordance with one embodiment.

In one embodiment, as illustrated in FIGS. 2-4, once a prize or award 108 is won, that prize may disappear, may move to another location, may be replaced by another prize, or may be redisplayed or remain in the same location, relative to a next game or spin. FIG. 4 illustrates an embodiment where, after the initial prize was won as shown in FIG. 3, the original prize which was won is no longer displayed and a new prize is displayed in a new location.

Figure 5:
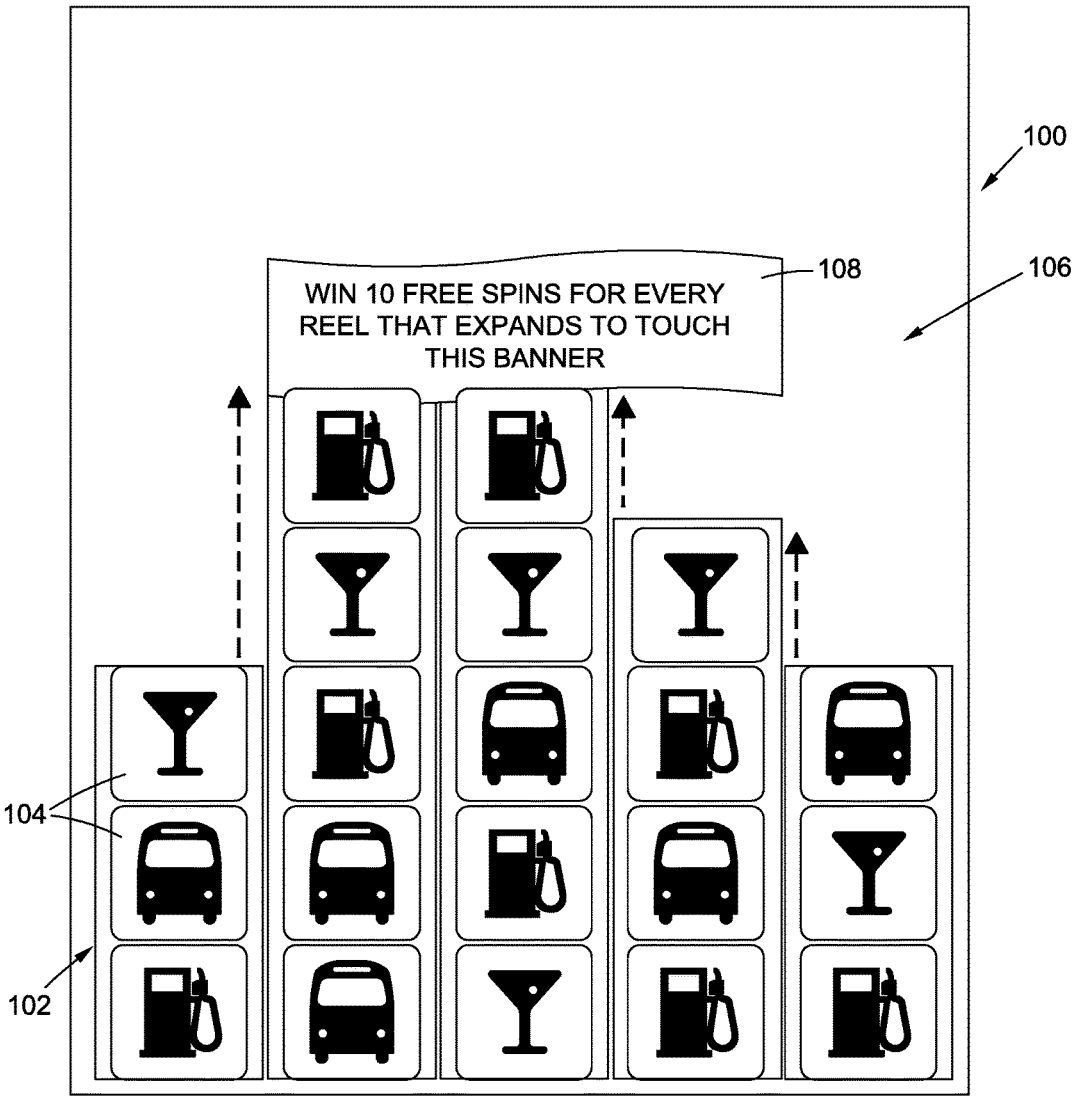
FIG. 5 illustrates a display or portion thereof displaying game information in accordance with one embodiment.

Another example of a prize of the invention is illustrated in FIG. 5. In this example, the prize may be won or triggered multiple times because it may be contacted or overlapped by more than one game symbol. For example, the prize may have a size which allows the symbols in more than one column to expand or increase in size into contact with the prize. FIG. 5 illustrates an example where if the symbols in more than one column increase or expand to contact the prize, then 10 free spins or games are awarded to the player. In other embodiment, the value of a prize might vary depending upon how many game symbols overlap or contact it. For example, a prize might be worth 10 credit if overlapped or contacted by a single game symbol but worth 50 credits if overlapped or contacted by two or more game symbols.

Notably, a prize may be located or sized so that it may not be contacted or overlapped by symbols in certain locations of the prize display area 106. For example, in FIG. 5, if an increased number of symbols is displayed relative to the first column of game symbols, those symbols will not ever contact the displayed prize and would thus not trigger the prize being won.

Figure 6:
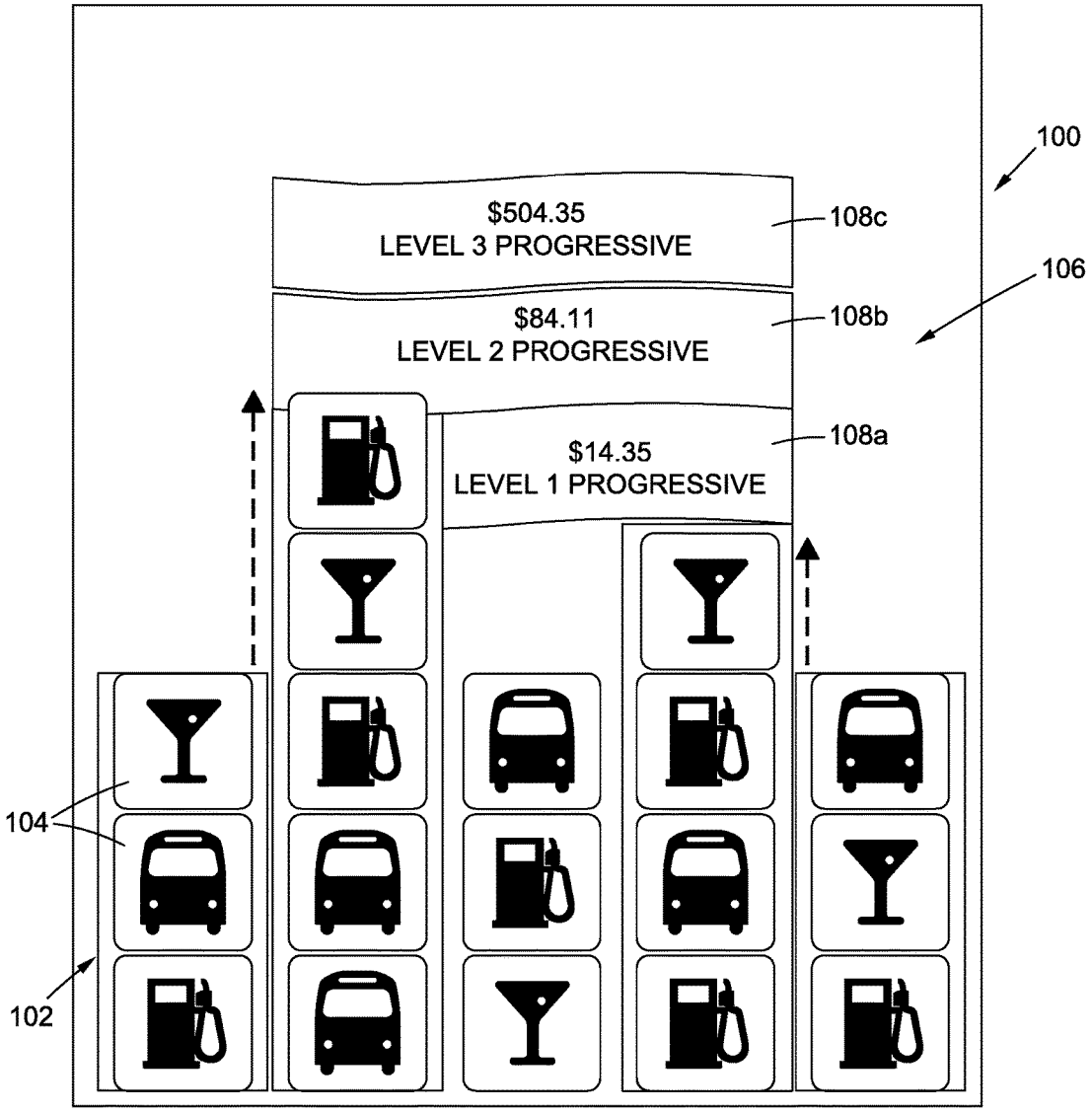
FIG. 6 illustrates a display or portion thereof displaying game information in accordance with one embodiment.

Another example of the invention is illustrated in FIG. 6. As illustrated, multiple prizes may be displayed in the prize display area 106. In such a configuration, one or more game symbols which are displayed in the prize display area 106 may contact more than one prize. For example, as illustrated in FIG. 6, three prizes 108*a,b,c* are displayed vertically above one another in the prize display area 106. As a result, the extra or expanded game symbols in the second column have contacted or overlapped both the first and second prizes 108*a,b*. In one embodiment, this might result in the player being awarded the highest value prize. In another embodiment, the player might be awarded both prizes.

Figure 7:
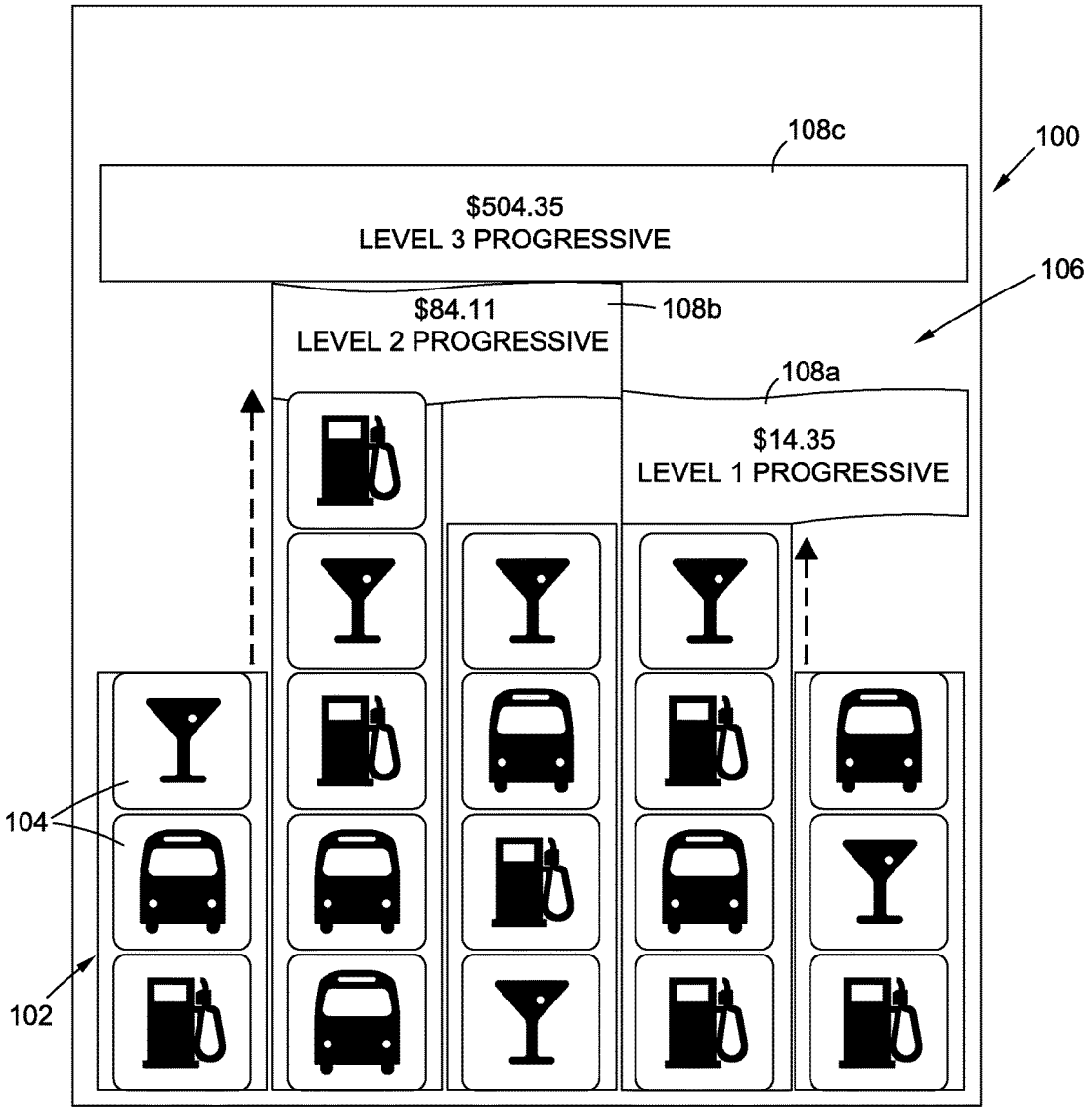
FIG. 7 illustrates a display or portion thereof displaying game information in accordance with one embodiment.

Another example of the invention is illustrated in FIG. 7. As illustrated, the size and/or location of prizes may cause them to only be interacted with by certain expansions of game symbols. In this example, a first prize 108*a* can only be won by an expansion of game symbols in the fourth and fifth reels or columns. On the other hand, a second prize 108*b* can only be won as a result of an expansion of game symbols in the second and third columns or reels. A third prize 109*c* can be won by an expansion of game symbols in any of the columns or reels, but only if the expansion is of a larger height.

Figure 8:
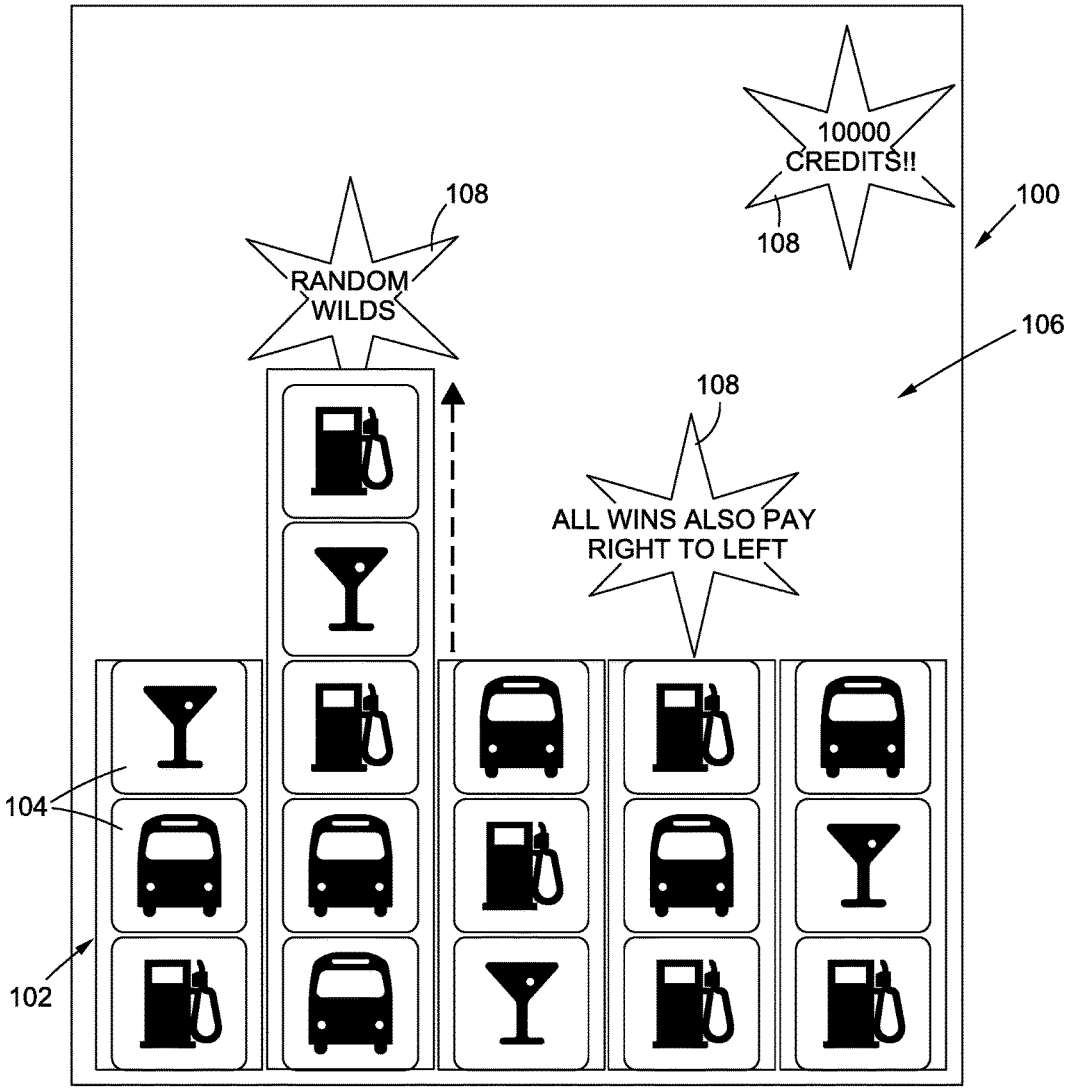
FIG. 8 illustrates a display or portion thereof displaying game information in accordance with one embodiment.

As indicated above, the types of prizes may vary. FIG. 8 illustrates an example where the prize may be a fixed award, such as 10,000 credits. FIG. 8 also illustrates an example where the prize may be a game feature, such as one which affects an outcome of the game as determined by the game symbols themselves.

Figure 9:
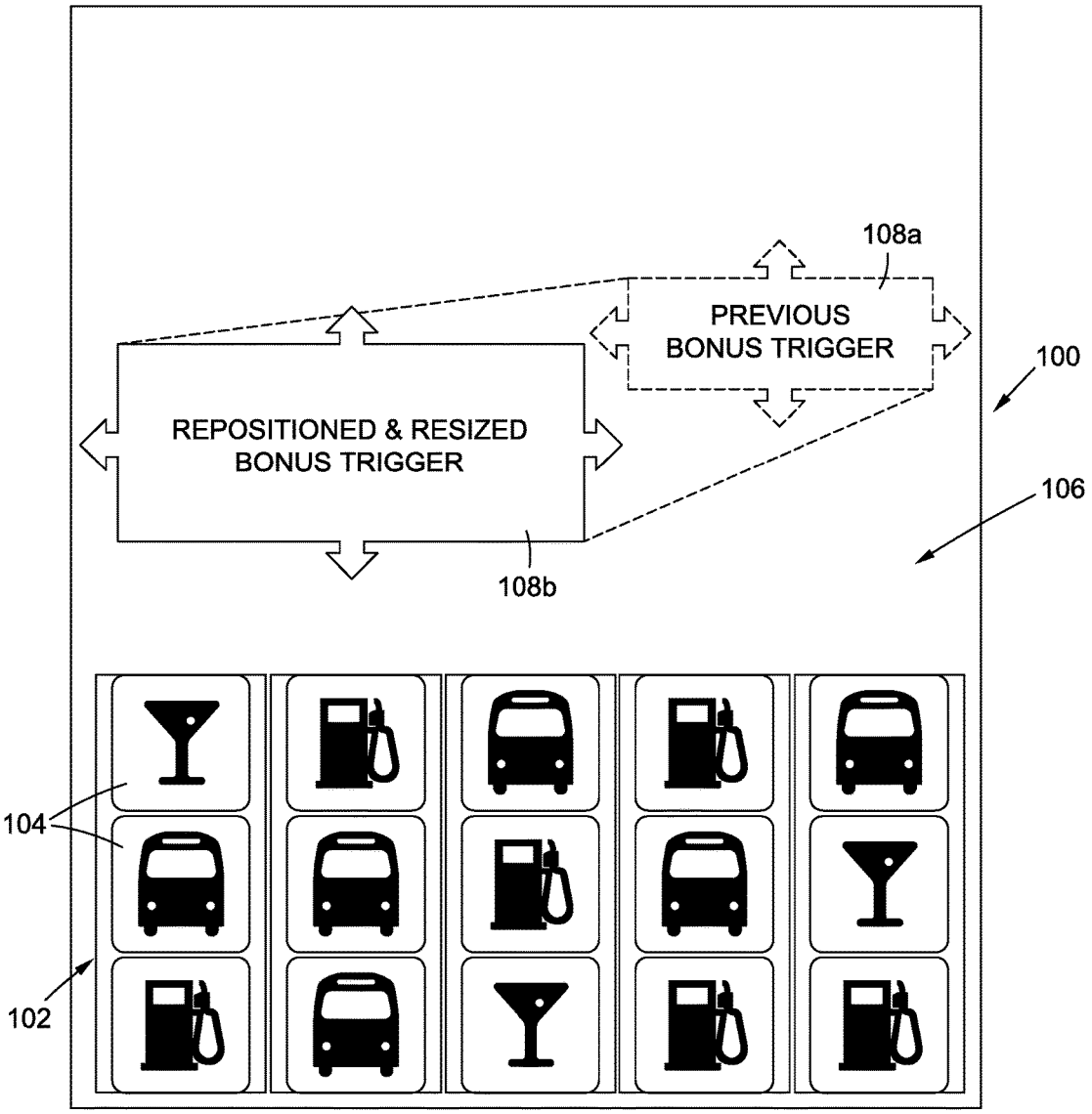
FIG. 9 illustrates a display or portion thereof displaying game information in accordance with one embodiment.

FIG. 9 illustrates yet another embodiment which illustrates how the size and/or location of one or more prizes may vary. As illustrated, at a first time, such as during one or more first games or spins, a first prize 108*a* may be displayed. This first prize 108*a* might have a first size and a first location. At a second time, such as during one or more second games or spins, a second prize 108*b* might be display. The second prize 108*b* might have a second size and a second location. Such a change in size and/or location of the displayed prize might be used to create a different impression to the player, such as creating the impression that the prize is easier or harder to win. In other embodiments, such a variation could directly impact the probability of winning the prize, such as where the probability of a higher symbol expansion is lower than the probability of a lower symbol expansion (e.g. the probability of the symbols expending upwardly by 3 symbols is lower than an expansion by 1 symbol). In such an event, the probability of the player receiving the first prize 108*a* may be lower than the probability of the player receiving the second prize 108*b*.

It will be appreciated that the game event of the invention may be implemented in various manners, such as in the form of a primary game, bonus game or the like. As noted herein, the game event is preferably presented as a wagering event or in association with or as part of a wagering event.

As one example, the game event may be presented as a direct wagering event. In this configuration, a player may place a wager to play the game event. The gaming machine may then initiate presentation of the game comprising causing a set of game symbols to be displayed (with any expansion of the game symbols) along with any prizes or awards in the prize display area. In one embodiment, a player may be awarded winnings for winning game symbol combinations or outcomes—what may be referred to as the "base" game outcome herein. In particular, after each game or spin, the game symbols (including the base game symbols and/or as modified by any expansion) may be evaluated for winning outcomes. In particular, winning combinations of symbols (such as along certain pay lines or in scatter or other format) may be defined as winning combinations and have associated awards (and where the remaining outcomes may be defined as non-winning or losing outcomes which do not have awards). The awards may comprise, for example, monetary value credit awards which may be associated with the player's credit balance (and later be cashed out by the player). The gaming machine may also determine whether any additional prizes or awards are won via contact or overlap of one or more game symbols with prizes displayed in the prize display area. In such a configuration, a player might: (1) obtain a winning base game outcome and win one of the additional prizes or awards as described above; (2) obtain a losing base outcome but still win one of the additional prizes or awards as described above; (3) obtain a winning base game outcome and not win one of the prizes or awards as described above; or (4) not obtain a winning base game outcome and not win one of the prizes or awards as described above.

As noted, the additional prize or award might comprise a number of monetary credits, but might also comprise a modification to the base game or the base game outcome. For example, the displayed combination of game symbols (the base game symbols and any additionally displayed symbols) might define a winning outcome having an associated award of 50 credits. The player might have also been awarded a 2× multiplier prize. As a result, the player is then awarded 100 credits (2 times the base win of 50 credits). As another example, the no winning outcome may result from the base game, but the player may have been awarded a "wild" symbol as a prize or award. The wild symbol might be placed into one of the game symbol locations and the resulting combination of game symbols might define a winning outcome for which the player is awarded an award.

In another embodiment, the configuration of the invention might be implemented as a secondary or bonus game to a primary wagering game. For example, a player might play a primary slot game or a base video poker game based upon a provided wager. Upon one or more triggers or other criteria, a secondary or bonus game might be presented. That secondary or bonus game might comprise one or more games or spins as described herein where the base game symbols and prizes or awards may be displayed. Such bonus games or spins might be presented without an additional wager by the player (beyond the one or more wagers on the original or primary games which led to the bonus event or game) or might require an additional wager.

The present invention has a number of advantages and features. One embodiment of the invention is a gaming machine which is uniquely configured to generate and display new and exciting information, in a new way which enables use of the information as part of the play of a wagering game. This information comprises the generation and display of information in the form of base symbols in a base symbol area, a prize display area with displayed prizes, and additional symbols displayed in the prize display area. The gaming machine and method result in the presentation of new, entertaining events for a player as the player watches the presented game display for displayed prizes and the potential addition of symbols into the prize display area for triggering the award of those prizes.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine comprising:

a monetary funds accepting mechanism for accepting monetary funds in creating a player credit balance;

at least one display device;

at least one player input device;

a memory device;

a controller; and machine-readable code stored in said memory device executable by said controller to, in response to a wager placed by said player from said player credit balance, to present a game event comprising:

causing said at least one display device to display a first spin of a set of reels in a base game symbol display area, said first spin of said set of reels displaying a first set of game symbols comprising two or more columns, each of said two or more columns having a first number of game symbols comprising at least one game symbol;

causing said at least one display device to display at least one prize in a prize display area said prize display area located above said base game symbol display area;

causing said at least one display device to display an expanded second set of game symbols in said base game symbol display area, said expanded second set of game symbols comprising said two or more columns having said first number of game symbols, and at least one of said two or more columns including at least one additional game symbol which is displayed at least partially in said prize display area;

determining if a prize winning condition has occurred comprising said at least one additional game symbol displayed at least partially in said prize display area contacting said at least one prize which is displayed in said prize display area; and awarding at least one award if said prize winning condition occurred.

2. The gaming machine in accordance with claim 1 wherein said at least one prize is displayed as a graphical element in said prize display area, and wherein a size of said graphical element may vary.

3. The gaming machine in accordance with claim 1 wherein said first set of game symbols comprise a matrix of M rows by N columns of game symbols.

4. The gaming machine in accordance with claim 3 wherein said expanded second set of game symbols comprises a matrix of M rows by N columns of game symbols and at least one of said N columns increased by at least one row.

5. The gaming machine in accordance with claim 1 wherein said at least one prize is displayed as a graphical icon having a size and location and wherein at least one of a size and location of at least one prize prevents game symbols in one or more of said columns of said expanded second set of game symbols from contacting said at least one prize to achieve a prize-winning condition.

6. The gaming machine in accordance with claim 1 wherein said at least one prize is displayed as a graphical icon and where a location of said graphical icon in said prize display area is varied.

7. The gaming machine in accordance with claim 1 wherein said at least one prize is displayed as a graphical icon and a size and/or location of said graphical icon is randomly determined.

8. The gaming machine in accordance with claim 1 further comprising causing said at least one display to no longer display said at least one prize if said prize winning condition has occurred.

9. The gaming machine in accordance with claim 1 wherein said machine-readable code further causes said controller to determine if at least one winning combination of game symbols exists relative to at least one of said first set of game symbols and said expanded second set of game symbols and to award at least one award for said at least one winning combination of game symbols.

10. The gaming machine in accordance with claim 1 wherein said game event comprise a bonus event to a primary game.

11. The gaming machine in accordance with claim 1 wherein said first set of game symbols is displayed relative to a first spin of said set of reels and said expanded second set of game symbols is displayed relative to a second spin of said set of reels.

12. A method of presenting a game event via an electronic gaming device, where the electronic gaming device includes one or more processors, the method comprising:

receiving via a credit device an item associated with a monetary value;

establishing via the one or more processors a credit balance based at least in part on the received item;

receiving via a wager button a wager amount on a play of a game, wherein the wager amount is deducted from the credit balance;

displaying via at least one display device a first spin of a set of reels in a game symbol display area, said first spin of said set of reels displaying a first set of game symbols comprising two or more columns, each of said two or more columns having a first number of game symbols comprising at least one game symbol;

displaying via said at least one display device at least one prize in a prize display area, said prize display area located above said base game symbol display area;

displaying via said at least one display device an expanded second set of game symbols in said base game symbol area, said expanded second set of game symbols comprising said two or more columns having said first number of game symbols, and at least one of said two or more columns including at least one additional game symbol which is displayed at least partially in said prize display area;

determining if a prize winning condition has occurred comprising said at least one additional game symbol at least partially displayed in said prize display area contacting said at least one prize which is displayed in said prize display area; and awarding at least one award if said prize winning condition occurred.

13. The method in accordance with claim 12 further comprising displaying said at least one prize as a graphical element in prize display area, and varying said size of said graphical element at one or more times.

14. The method in accordance with claim 12 wherein said first set of game symbols comprise a matrix of M rows by N columns of game symbols.

15. The method in accordance with claim 14 wherein said expanded second set of game symbols comprises a matrix of M rows by N columns of game symbols and at least one of said N columns increased by at least one row.

16. The method in accordance with claim 12 further comprising displaying said at least one prize as a graphical icon having a size and location which prevent them from being contracted by game symbols in at least one column of said expanded set of game symbols wherein.

17. The method in accordance with claim 12 further comprising displaying said at least one prize is displayed as a graphical icon and varying a location of said graphical icon in said prize display area at one or more times.

18. The method in accordance with claim 12 further comprising displaying said at least one prize as a graphical icon and randomly determining a size and/or location of said graphical icon.

19. The method in accordance with claim 12 further comprising no longer displaying said at least one prize if said prize winning condition has occurred.

20. The method in accordance with claim 12 further comprising determining if at least one winning combination of game symbols exists relative to at least one of said first set of game symbols and said expanded second set of game symbols and awarding at least one award for said at least one winning combination of game symbols.

* * * * *